US008899969B2

(12) United States Patent
Gard et al.

(10) Patent No.: US 8,899,969 B2
(45) Date of Patent: Dec. 2, 2014

(54) METHOD AND SYSTEM FOR LOW-$NO_x$ DUAL-FUEL COMBUSTION OF LIQUID AND/OR GASEOUS FUELS

(75) Inventors: Vincent Gard, Streamwood, IL (US); Dennis A. Chojnacki, Roselle, IL (US); Ioseph K. Rabovitser, Skokie, IL (US)

(73) Assignee: Gas Technology Institute, Des Plaines, IL (US)

( * ) Notice: Subject to any disclaimer, the term of this patent is extended or adjusted under 35 U.S.C. 154(b) by 724 days.

(21) Appl. No.: 13/156,396

(22) Filed: Jun. 9, 2011

(65) Prior Publication Data

US 2012/0315586 A1 Dec. 13, 2012

(51) Int. Cl.

| | |
|---|---|
| ***F23J 7/00*** | (2006.01) |
| ***F23D 14/58*** | (2006.01) |
| ***F23D 17/00*** | (2006.01) |
| ***F23C 9/06*** | (2006.01) |
| ***F23C 6/04*** | (2006.01) |
| ***F23K 5/22*** | (2006.01) |
| ***F23D 11/38*** | (2006.01) |
| ***F23D 11/44*** | (2006.01) |
| ***F23C 1/08*** | (2006.01) |
| ***F23D 11/10*** | (2006.01) |
| ***F23N 1/02*** | (2006.01) |

(52) U.S. Cl.

CPC . *F23C 1/08* (2013.01); *F23D 14/58* (2013.01); *F23D 17/002* (2013.01); *F23C 9/06* (2013.01); *F23C 2201/401* (2013.01); *F23C 6/04* (2013.01); *F23K 5/22* (2013.01); *F23D 11/38* (2013.01); *F23D 11/44* (2013.01); *F23C 2900/06041* (2013.01); *F23D 2204/10* (2013.01); *F23D 11/10* (2013.01); *F23N 1/02* (2013.01)

USPC ..... 431/4; 431/2; 431/11; 122/40; 122/41; 60/39.464; 60/39.55

(58) Field of Classification Search

CPC .... C10L 1/328; F23C 2201/301; F23C 6/045; F23C 6/047; F23D 11/16; F23D 17/002; F23K 5/12; Y02E 20/12

USPC ..... 431/4, 11; 122/40, 41; 44/301; 60/39.464, 39.55

See application file for complete search history.

(56) References Cited

U.S. PATENT DOCUMENTS 3,731,876 A 5/1973 Showalter
3,766,942 A * 10/1973 Delatronchette et al. ..... 137/565.29

(Continued)

FOREIGN PATENT DOCUMENTS

JP 58187714 A * 11/1983 ..... F23D 11/16

OTHER PUBLICATIONS

JP 58187714 A—English Abstract.*

*Primary Examiner* — Jorge Pereiro
(74) *Attorney, Agent, or Firm* — Pauley Petersen & Erickson

(57) ABSTRACT

A method and apparatus for combustion in which a pressurized preheated liquid fuel is atomized and a portion thereof flash vaporized, creating a mixture of fuel vapor and liquid droplets. The mixture is mixed with primary combustion oxidant, producing a fuel/primary oxidant mixture which is then injected into a primary combustion chamber in which the fuel/primary oxidant mixture is partially combusted, producing a secondary gaseous fuel containing hydrogen and carbon oxides. The secondary gaseous fuel is mixed with a secondary combustion oxidant and injected into the second combustion chamber wherein complete combustion of the secondary gaseous fuel is carried out. The resulting second stage flue gas containing very low amounts of $NO_x$ is then vented from the second combustion chamber.

21 Claims, 12 Drawing Sheets

(56) References Cited

U.S. PATENT DOCUMENTS

| | | | | | |
|---|---|---|---|---|---|
| 3,876,363 | A | * | 4/1975 | La Haye et al. | 431/11 |
| 3,897,200 | A | * | 7/1975 | Childree | 431/243 |
| 3,934,969 | A | * | 1/1976 | Noda et al. | 431/9 |
| 3,938,933 | A | | 2/1976 | Cardenes Armas | |
| 3,958,915 | A | * | 5/1976 | Noda et al. | 431/9 |
| 4,008,038 | A | * | 2/1977 | Berthiaume | 431/11 |
| 4,063,871 | A | * | 12/1977 | Durin | 431/89 |
| 4,116,610 | A | * | 9/1978 | Berthiaume | 431/4 |
| 4,257,763 | A | * | 3/1981 | Reed | 431/188 |
| 4,347,052 | A | * | 8/1982 | Reed et al. | 431/188 |
| 4,488,866 | A | * | 12/1984 | Schirmer et al. | 431/4 |
| 4,696,638 | A | * | 9/1987 | DenHerder | 431/4 |
| 4,879,959 | A | * | 11/1989 | Korenberg | 110/264 |
| 5,217,362 | A | | 6/1993 | Thompson et al. | |
| 5,511,969 | A | * | 4/1996 | Lopes et al. | 431/4 |
| 6,012,915 | A | | 1/2000 | Mori et al. | |
| 6,109,911 | A | * | 8/2000 | Tamminen et al. | 431/4 |
| 6,132,202 | A | | 10/2000 | Eroglu et al. | |
| 6,290,487 | B1 | * | 9/2001 | Velke | 431/11 |
| 6,422,858 | B1 | * | 7/2002 | Chung et al. | 431/8 |
| 6,601,776 | B1 | | 8/2003 | Oljaca et al. | |
| 6,663,380 | B2 | | 12/2003 | Rabovitser et al. | |
| 6,672,859 | B1 | | 1/2004 | Rabovitser et al. | |
| 6,793,483 | B2 | * | 9/2004 | Watanabe | 431/4 |
| 6,971,336 | B1 | | 12/2005 | Chojnacki et al. | |
| 2009/0005950 | A1 | | 1/2009 | Scalia, Jr. | |
| 2010/0183990 | A1 | * | 7/2010 | Watson et al. | 431/8 |
| 2011/0219780 | A1 | * | 9/2011 | Prabhu | 60/775 |

* cited by examiner (b)

(a)

METHOD AND SYSTEM FOR LOW-$NO_x$ DUAL-FUEL COMBUSTION OF LIQUID AND/OR GASEOUS FUELS

The U.S. Government has a paid-up license in this invention and the right in limited circumstances to require the patent owner to license others on reasonable terms as provided for by the terms of Contract No. DE-FG36-05GO15189 awarded by the U.S. Department of Energy.

BACKGROUND OF THE INVENTION

1. Field of the Invention

This invention relates to a method and apparatus for combustion of liquid fuels or mixtures of liquid and gaseous fuels. In one aspect, this invention relates to emissions produced by the combustion of liquid fuels and mixtures of liquid and gaseous fuels. In one aspect, this invention relates to the control of $NO_x$ emissions resulting from the combustion of liquid fuels and mixtures of liquid and gaseous fuels. In one aspect, this invention relates to a method and apparatus for dual-fuel combustion, i.e., combustion of a mixture of liquid and gaseous fuels. In one aspect, this invention relates to dual-fuel combustion in boilers for steam and power generation.

2. Description of Related Art

To increase the cost-effectiveness of steam and power generation by the utilization of low cost liquid and gaseous fuels, including waste liquid fuels and low Btu gaseous fuels, the combustion system should be capable of dual-fuel combustion, i.e., the combustion of a mixture of liquid and gaseous fuels, while maintaining high efficiency and low emissions ($NO_x$, CO, $CO_2$, unburned hydrocarbons, particulate emissions, and the like) to meet the limits set by the U.S. Environmental Protection Agency (EPA) in different regions of the United States, including California. The best available combustion technology does not provide dual-fuel capability with low emissions for both liquid and gaseous fuels and, as a result, usage of liquid fuels, in particular, is limited in many areas and even prohibited in some areas, such as southern California.

Low emissions dual-fuel burners or oil burners that achieve relatively low $NO_x$ emissions, on the order of 60-70 ppmv at 3% $O_2$, usually utilize flue gas recirculation (FGR) where a portion of the flue gases generated by fuel combustion, up to about 20%, is recirculated into the combustion chamber, thereby lowering the peak flame temperatures and the percentage of oxygen in the combustion air/flue gas mixture which, in turn, retards the formation of $NO_x$ caused by high flame temperatures (thermal $NO_x$). Although flue gas recirculation reduces the peak flame temperature to reduce thermal $NO_x$ formation, it does not reduce the fuel-bound $NO_x$ formation. Consequently, the use of flue gas recirculation in the combustion of oil and other liquid fuels is typically limited to $NO_x$ values upward of 60 ppmv depending on the nitrogen content of the particular liquid fuel.

Conventional liquid fuel combustion typically utilizes atomization of the liquid fuel to produce liquid fuel droplets and, thus, facilitate combustion. U.S. Pat. No. 6,601,776 to Oljaca et al. teaches methods and devices for atomization of liquids for use in a variety of applications such as flame and plasma-based atomic spectroscopy, nano-powder production, particle/droplet seeding for laser-based flow diagnostics, spray drying for the production of fine powders, nebulizers for inhalation in delivery of medication, and for atomizing liquid fuel for use in combustion chambers, and teaches the use of heat-based atomization in which a pressurized liquid is raised to an elevated temperature in an atomization nozzle, resulting in a heated spray that is more resistant to re-condensation. The atomizer is in the form of a heated tube containing a pressurized liquid which is atomized at a reduced pressure, forming fine droplets as well as partial vapor. Atomization of the pressurized liquid is tailored by modifying the heating profile of the heated tube to allow controlled atomization of different liquids and/or combinations of liquids having different atomization requirements, or to adjust the mean particle size and size distribution needed for a particular application.

U.S. Patent Application Publication 2009/0005950 to Scalia, Jr. teaches a method and apparatus for uniformly controlling a combustion system by a transfer of heat to a fluidic fuel along a heat/fuel interface having a large surface area immediately prior to mixing of the fuel with air. Control of the temperature of the fuel input to an air/fuel mixing region of the combustion system is said to provide improved efficiency by an expansion of modulation ranges available for factors that together are determinative of the combustion efficiency, such as fuel flow rate, fuel droplet size, air flow, and input fuel pressure. Preheating of the liquid fuel is used to control the droplet size and distribution and rapid ignition in the air/fuel mixing region inside the combustion chamber.

U.S. Pat. No. 6,012,915 to Mori et al. teaches a method of combusting a water/fossil fuel mixed emulsion comprising elevating the temperature of the emulsion and vaporizing the emulsion, jetting the water/fossil fuel mixed gas thus formed from a burner, and bringing a Brown's gas flame of a Brown's gas combustion burner in contact with the flow of the mixed gas, thereby combusting the water/fossil fuel mixed gas. The emulsion is indicated to be a non-combustible waste having a water content of about 90%, for which the use of the Brown's gas burner is required to ignite and maintain the combustion of the emulsion.

U.S. Pat. No. 6,971,336 to Chojnacki et al. teaches a fire-tube boiler system comprising a pressure vessel containing two combustion sections and an in-line intermediate tubular heat transfer section between the two combustion sections. The system utilizes staged oxidant combustion for fuel-rich combustion in the first combustion section and fuel-lean combustion in the second combustion section with sufficient cooling of the combustion products from the first combustion section such that when the secondary oxidant is provided to the second combustion section, the $NO_x$ formation is less than about 5 ppmv at 3% $O_2$. However, the substoichiometric combustion of liquid fuels using this system undesirably produces a substantial amount of soot in the first combustion chamber for which no provisions for prevention or suppression are provided.

SUMMARY OF THE INVENTION

It is, thus, one object of this invention to provide a method and apparatus for combustion of a liquid fuel or a mixture of liquid fuel and gaseous fuel which is able to meet the objectives of maintaining high efficiency and low emissions to meet the limits set by the U.S. Environmental Protection Agency (EPA) in different regions of the United States, including California.

This and other objects of this invention are addressed by a method and apparatus for combustion in which a pressurized preheated liquid fuel is atomized, producing an atomized liquid fuel and at least a portion of the atomized liquid fuel is flash vaporized, producing a liquid-fuel mixture comprising the atomized liquid fuel and the vaporized fuel. The mixture of atomized liquid fuel and vaporized fuel, referred to herein as a liquid-fuel mixture, is mixed with a primary combustion oxidant in a mixing chamber, producing a mixture of fuel and oxidant, referred to herein as a fuel/oxidant mixture, having a primary stoichiometry less than about 1.0, i.e. a fuel-rich stoichiometry. The fuel/oxidant mixture is introduced into a first combustion chamber in which, due to the fuel-rich stoichiometry of the mixture, partial combustion of the fuel/oxidant mixture is carried out, producing a secondary fuel gas typically containing $H_2$, CO, $CO_2$, and unburned fuel. The secondary fuel gas is cooled, producing a cooler secondary fuel gas which is mixed with a secondary combustion oxidant, producing a mixture of secondary fuel gas and oxidant, referred to herein as a secondary fuel gas/oxidant mixture. The secondary fuel gas/oxidant mixture is introduced into a second combustion chamber in which substantially complete combustion of the secondary fuel gas/oxidant mixture is carried out, producing flue gases which are then vented from the second combustion chamber. In accordance with one embodiment of this invention, a gaseous fuel may be mixed with the liquid-fuel mixture and primary combustion oxidant. As used herein, the term "oxidant" means "air", "oxygen-enriched air" or "oxygen." The prior art suggests that substoichiometric combustion of a liquid fuel produces substantial amounts of undesirable soot in the combustion chamber. Surprisingly, the combustion method and apparatus of this invention provide low-$NO_x$ combustion, i.e., less than about 20 ppmv for liquid fuels and less than about 5 ppmv for gaseous fuels, while maintaining high efficiency substantially without the formation of soot.

BRIEF DESCRIPTION OF THE DRAWINGS

This and other objects and features of this invention will be better understood from the following detailed description taken in conjunction with the drawings, wherein.

DETAILED DESCRIPTION OF THE PRESENTLY PREFERRED EMBODIMENTS

The invention described herein is a method and system for providing low-$NO_x$ combustion of a liquid fuel while maintaining high efficiency and substantially avoiding soot formation. As used herein, the term "low-$NO_x$" refers to $NO_x$ emission levels less than about 20 ppmv for liquid fuels and less than about 5 ppmv for gaseous fuels. The invention comprises the following features, which will be discussed in more detailed herein below: atomization of liquid fuel, partial liquid fuel evaporation, premixing of gaseous fuel or vapors of liquid fuel with primary combustion oxidant, oxidant-staged combustion, and forced internal flue gas recirculation. As used herein, the terms "atomizing" and "atomization" refer to a process whereby a liquid is transformed into a plurality of droplets and the terms "evaporating", "vaporizing", "evaporation", and "vaporization" refer to a process in which a liquid is converted to a vapor.

Figure 1:
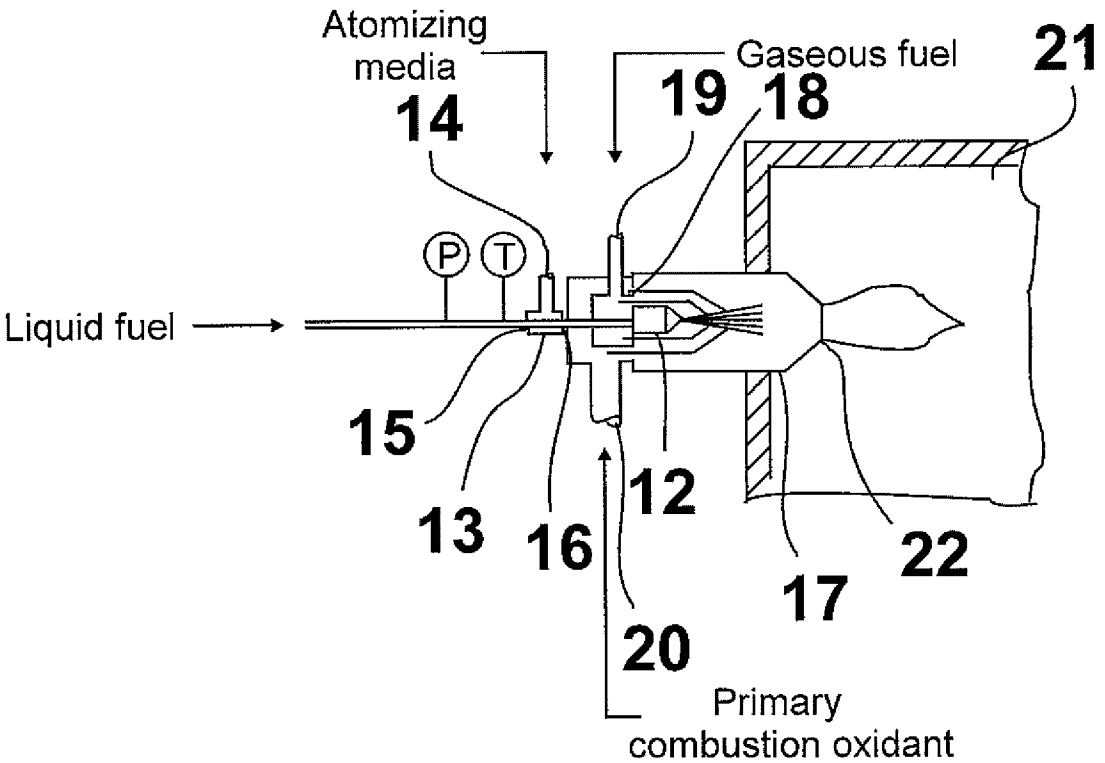
FIG. 1 is a schematic diagram of a dual-fuel burner for combustion of a liquid fuel or a mixture of a liquid fuel and a gaseous fuel in accordance with one embodiment of this invention.

FIG. 1 shows a combustion apparatus for combustion of a liquid fuel or a mixture of a liquid fuel and a gaseous fuel in accordance with one embodiment of this invention comprising an atomizer 13 having an atomizing media inlet 14, a pressurized preheated liquid fuel inlet 15 and an atomized liquid fuel outlet 16, a liquid fuel nozzle 12 having an atomized liquid fuel inlet in fluid communication with the atomized liquid fuel outlet of the atomizer and having a vaporized fuel outlet, and a burner nozzle 17 having a burner nozzle liquid fuel inlet 18 in fluid communication with the vaporized fuel outlet of the liquid fuel nozzle. The pressurized preheated liquid fuel is atomized proximate the atomized liquid fuel outlet to produce a plurality of liquid fuel droplets which are introduced through burner nozzle liquid fuel inlet 18 into the burner nozzle in which a portion of the liquid fuel droplets are partially flash vaporized. Preferred liquid fuel droplet sizes produced by the atomizer are less than about 20 μm in diameter. Atomizers for atomizing liquid fuels are well known and any atomizer suitable for producing liquid fuel droplets less than about 20 μm in diameter may be used. In accordance with one preferred embodiment of this invention, the atomizing medium used to atomize the pressurized preheated liquid fuel is selected from the group consisting of compressed air, steam, vented flue gas, and mixtures thereof.

In addition to the inlet for liquid fuel droplets and vapor, burner nozzle 17, in accordance with one embodiment of this invention, is provided with a gaseous fuel inlet 19 and a primary combustion oxidant inlet 20 through which a gaseous fuel and a primary combustion oxidant, respectively, e.g., air, are introduced into the burner nozzle for mixing with the liquid fuel droplets and partially vaporized liquid fuel prior to being expelled through burner nozzle outlet 22 for combustion in first combustion chamber 21. It will be appreciated by those skilled in the art that the gaseous fuel inlet shown in FIG. 1 may be eliminated for those applications in which only liquid fuels are employed. In accordance with one preferred embodiment of this invention, the gaseous fuel inlet and primary combustion oxidant inlet are arranged to enable tangential introduction of the gaseous fuel and primary combustion oxidant into the burner nozzle. The amount of primary combustion oxidant provided to the burner nozzle, whether for liquid fuel combustion alone or dual-fuel combustion, is selected so as to maintain a primary, fuel-rich, stoichiometry in the burner nozzle of less than 1.0 and preferably in a range of about 0.50 to about 0.75.

Figure 2:
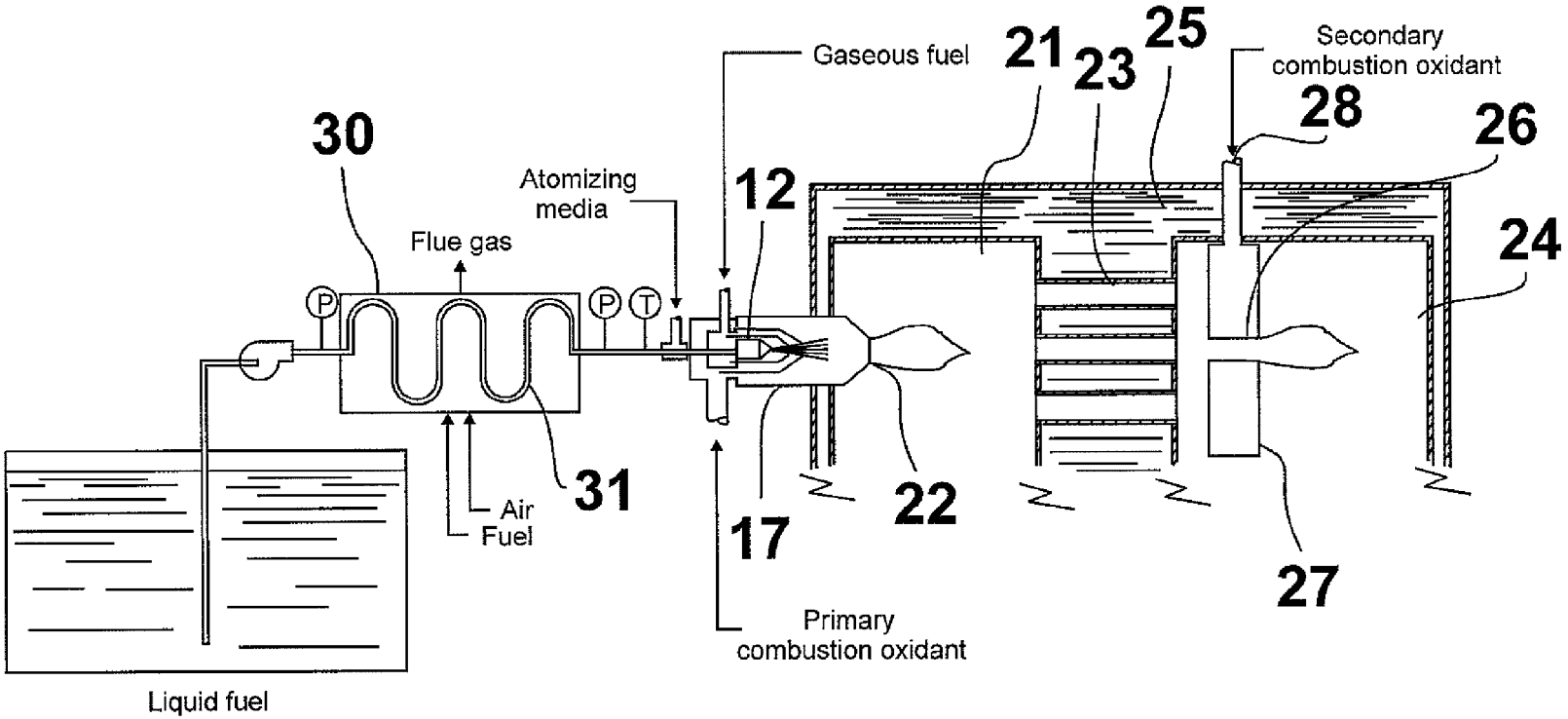
FIG. 2 is a schematic diagram of a lateral view of a portion of a fluid heating apparatus employing a dual-fuel burner for combustion of a liquid and gaseous fuel mixture in accordance with one embodiment of this invention.

FIG. 2 shows an apparatus for fluid heating utilizing a dual-fuel combustion apparatus in accordance with one embodiment of this invention. It will be appreciated by those skilled in the art that the same apparatus, as well as the apparatuses shown in the remaining figures, may be used for liquid fuel combustion alone in accordance with the method of this invention and such apparatuses are deemed to be within the scope of this invention. As shown therein, the fluid heating apparatus comprises at least one combustion apparatus (FIG. 1), a first combustion chamber 21 in fluid communication with burner nozzle outlet 22, a second combustion chamber 24 downstream of the first combustion chamber, and an intermediate cooling section 23 providing fluid communication between the first combustion chamber 21 and the second combustion chamber 24. The apparatus further comprises a second stage burner nozzle 26 and a secondary combustion oxidant plenum having a secondary combustion oxidant inlet 28 and adapted to provide secondary combustion oxidant to the second stage burner nozzle for mixing with secondary fuel gas generated in the first combustion chamber. The fluid heating apparatus further comprises means for preheating the liquid fuel prior to atomization.

In the operation of the apparatus, a pressurized preheated liquid fuel is introduced into atomizer 13 in which the pressurized preheated liquid fuel is atomized to produce a plurality of liquid fuel droplets. As a result of a significant reduction in liquid fluid pressure exiting the atomizer, a portion of the liquid fuel droplets are flash vaporized, producing a mixture of liquid fuel droplets and vaporized fuel, which mixture is provided through liquid fuel nozzle 12 to burner nozzle 17 for mixing with primary combustion oxidant provided through primary combustion oxidant inlet 20, or in the case of dual-fuel combustion, with a gaseous fuel introduced through gaseous fuel inlet 19 and primary combustion oxidant, producing a fuel/oxidant mixture. With a primary stoichiometry less than 1.0, the fuel/oxidant mixture is introduced through burner nozzle outlet 22 into the first combustion chamber in which the mixture is partially combusted, producing a secondary fuel gas. The secondary fuel gas, which is typically at a temperature in the range of about 1500° F. to about 1700° F., is introduced into the cooling section 23 interposed between the first and second combustion chambers and cooled to a temperature in the range of about 1100° F. to about 1300° F. following which the cooler secondary fuel gas is introduced into a secondary fuel nozzle 26 in which it is mixed with secondary combustion oxidant for combusting in the second combustion chamber 24.

Figure 5:
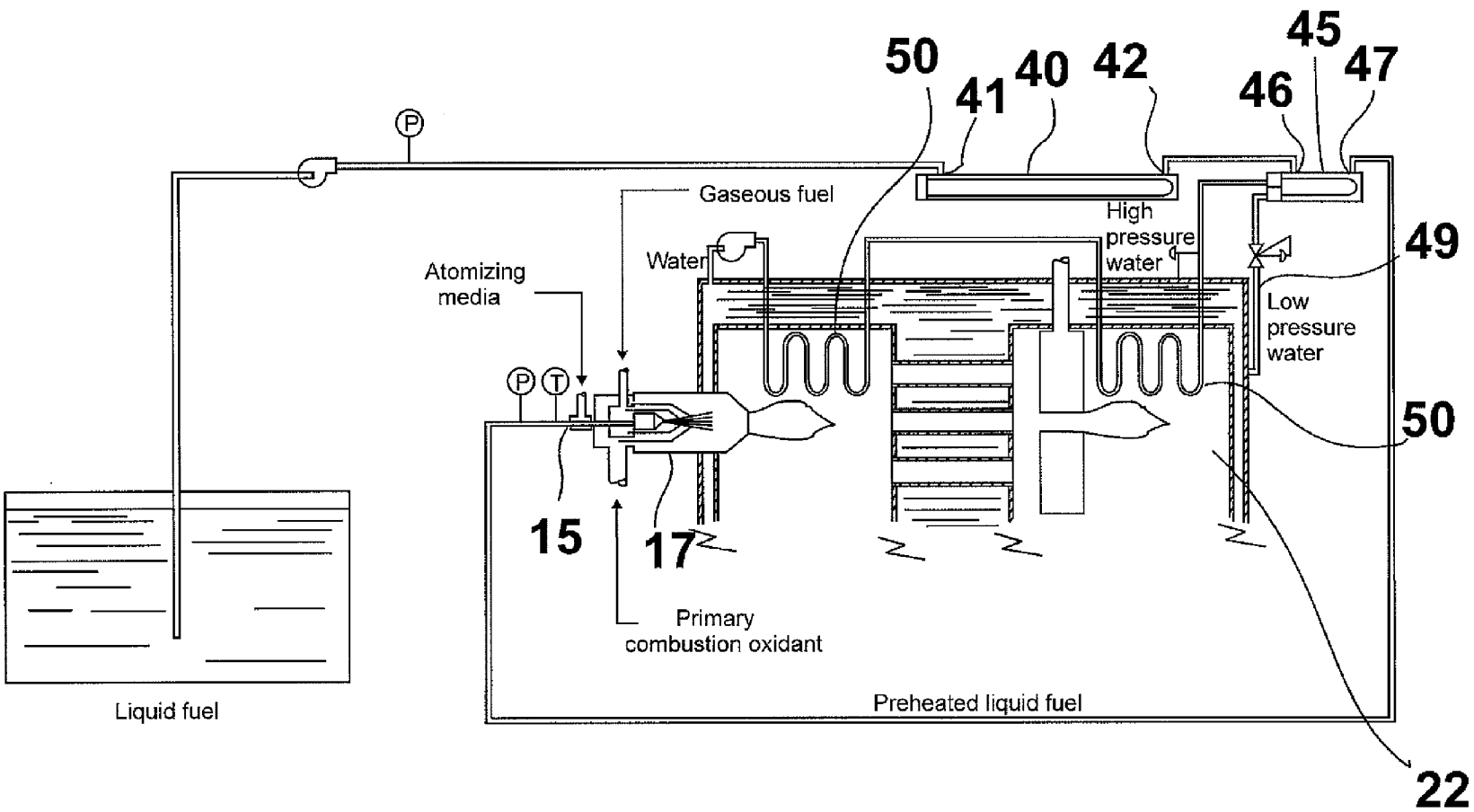
FIG. 5 is a schematic diagram of a lateral view of a portion of a fluid heating apparatus employing a dual-fuel burner for combustion of a liquid and gaseous fuel mixture in accordance with one embodiment of this invention in which the liquid fuel is preheated using fluid heated in the fluid heating apparatus.

Liquid fuel employed in the method and apparatus of this invention is pressurized and preheated before being atomized as indicated herein above. Accordingly, the apparatus of this invention comprises liquid fuel preheating means for preheating the liquid fuel. In accordance with one embodiment of this invention as shown in FIG. 2, the liquid fuel preheating means comprises a supplemental combustion unit 30 containing a heat exchanger 31 through which the liquid fuel is transmitted such that heat from combustion of fuel and air is transferred to the liquid fuel flowing through the heat exchanger. In accordance with one embodiment of this invention, the liquid fuel preheating means comprises an electric liquid fuel preheater, a water-liquid fuel preheater, and/or a steam-liquid fuel preheater. In accordance with one embodiment of this invention, the liquid fuel preheating means comprises a combination of an electric liquid fuel preheater 40 having a liquid fuel inlet 41 and a partially preheated liquid fuel outlet 42 and a water-liquid fuel heater 45 having a partially preheated liquid fuel inlet 46 in fluid communication with the partially preheated liquid fuel outlet of the electric liquid fuel preheater and a preheated liquid fuel outlet 47 in fluid communication with the preheated liquid fuel inlet 15 of the dual-fuel combustion apparatus as shown in FIG. 5. As previously indicated, the dual-fuel combustion apparatus of this invention may be employed in a fluid heating apparatus (FIG. 2), such as a boiler, in which a fluid, e.g. water, 25 is heated. In this case, heating of the partially preheated liquid fuel in water-liquid fuel heater 45 is accomplished using heated water from the fluid heating apparatus and a heat exchanger 50 disposed within the second combustion chamber through which the heated water is transmitted, producing heated high pressure water, typically pressurized to a pressure of about 200 psig, which is provided to the water-liquid fuel heater 45. The high pressure water is cooled within the water-liquid fuel heater by heat exchange with the partially preheated liquid fuel, producing low pressure water, which is returned by way of line 49 to the fluid heating apparatus. As shown in FIG. 5, in accordance with one embodiment of this invention, the heat exchanger 50 is disposed within the second combustion chamber 22. In accordance with another embodiment of this invention, the heat exchanger is disposed in the first combustion chamber and in accordance with yet another embodiment of this invention, the heat exchanger is disposed within both the first and second combustion chambers.

Figure 6:
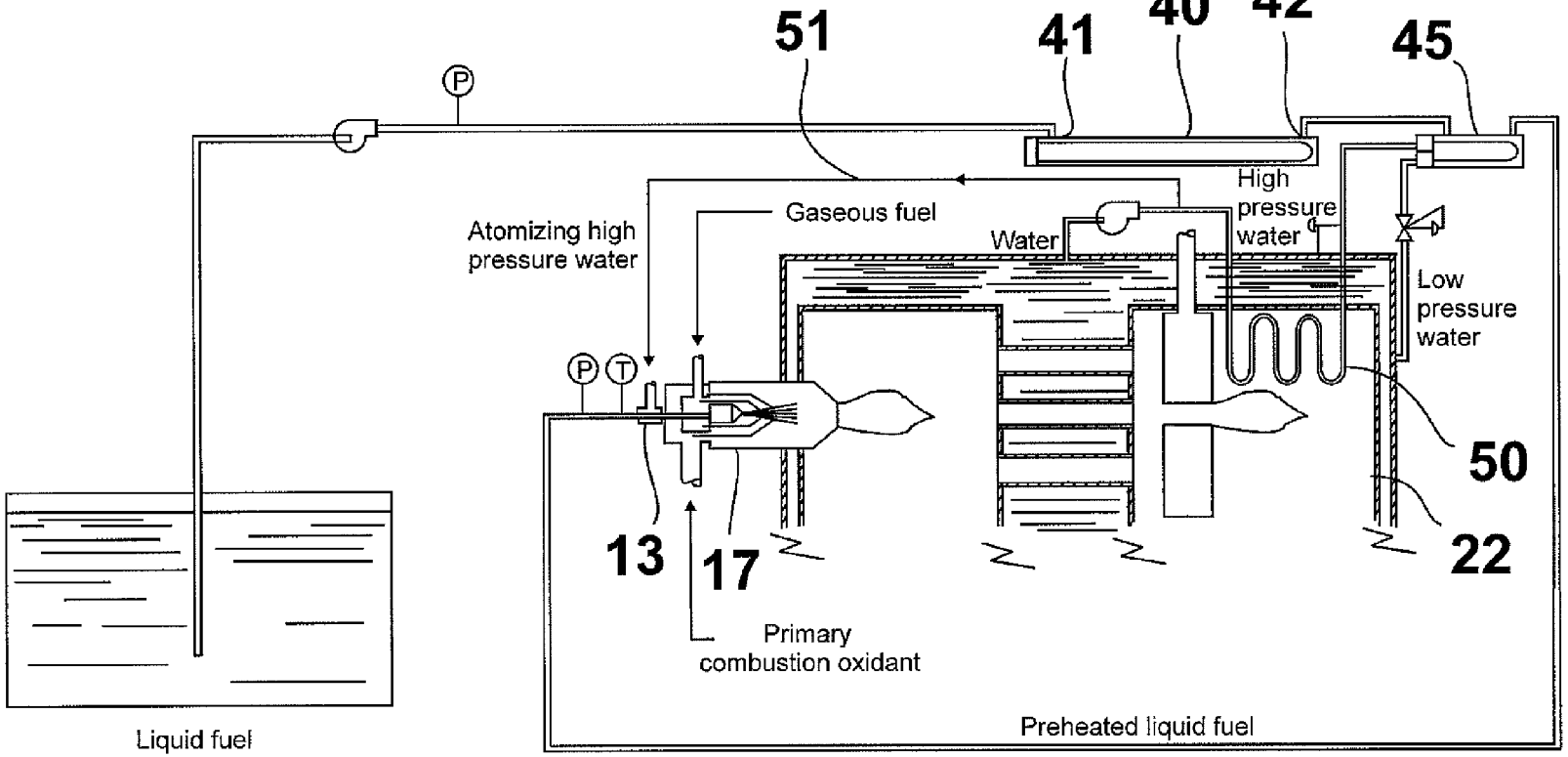
FIG. 6 is a schematic diagram of a lateral view of a portion of a fluid heating apparatus employing dual-fuel combustion in which high pressure water is used as an atomizing medium for atomizing the liquid fuel in accordance with one embodiment of this invention.

The dual-fuel fluid heating apparatus of this invention provides the opportunity to use a variety of fluids as an atomizing medium for atomizing the preheated liquid fuel. In accordance with one embodiment of this invention as shown in FIG. 6, the apparatus comprises a high pressure water conduit, indicated by line 51, through which a portion of the high pressure water used to preheat the liquid fuel is provided to atomizer 13 for use as an atomizing medium.

Figure 7:
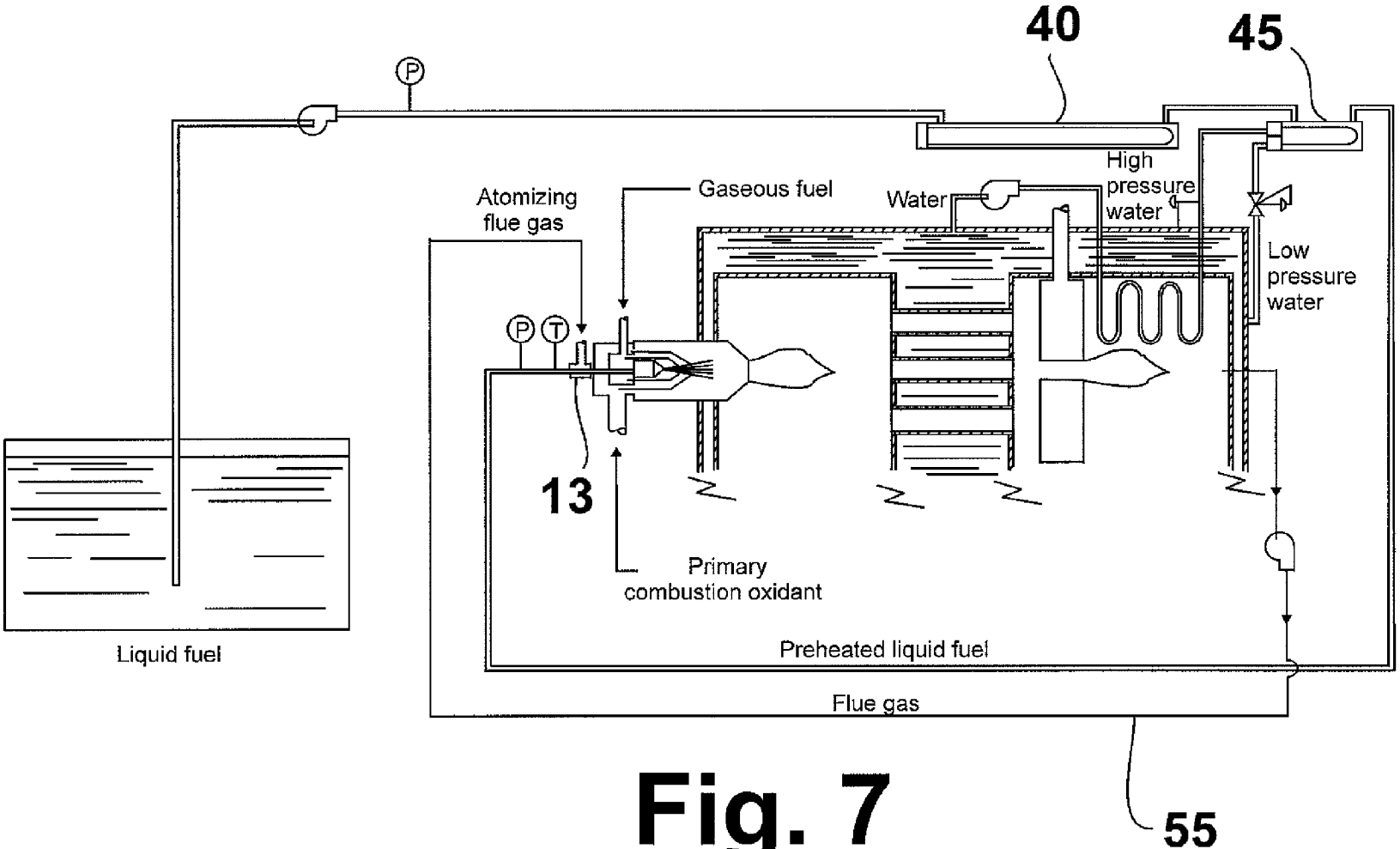
FIG. 7 is a schematic diagram of a lateral view of a portion of a fluid heating apparatus employing dual-fuel combustion in which flue gas generated by the combustion process is used as an atomizing medium for atomizing the liquid fuel in accordance with one embodiment of this invention.

In accordance with one embodiment of this invention, flue gas generated in the second combustion chamber is used as an atomizing medium. As shown in FIG. 7, the apparatus comprises a flue gas conduit, indicated by line 55, through which flue gas from the second combustion chamber 22 is provided to atomizer 13 for use in atomizing the preheated liquid fuel.

Figure 8:
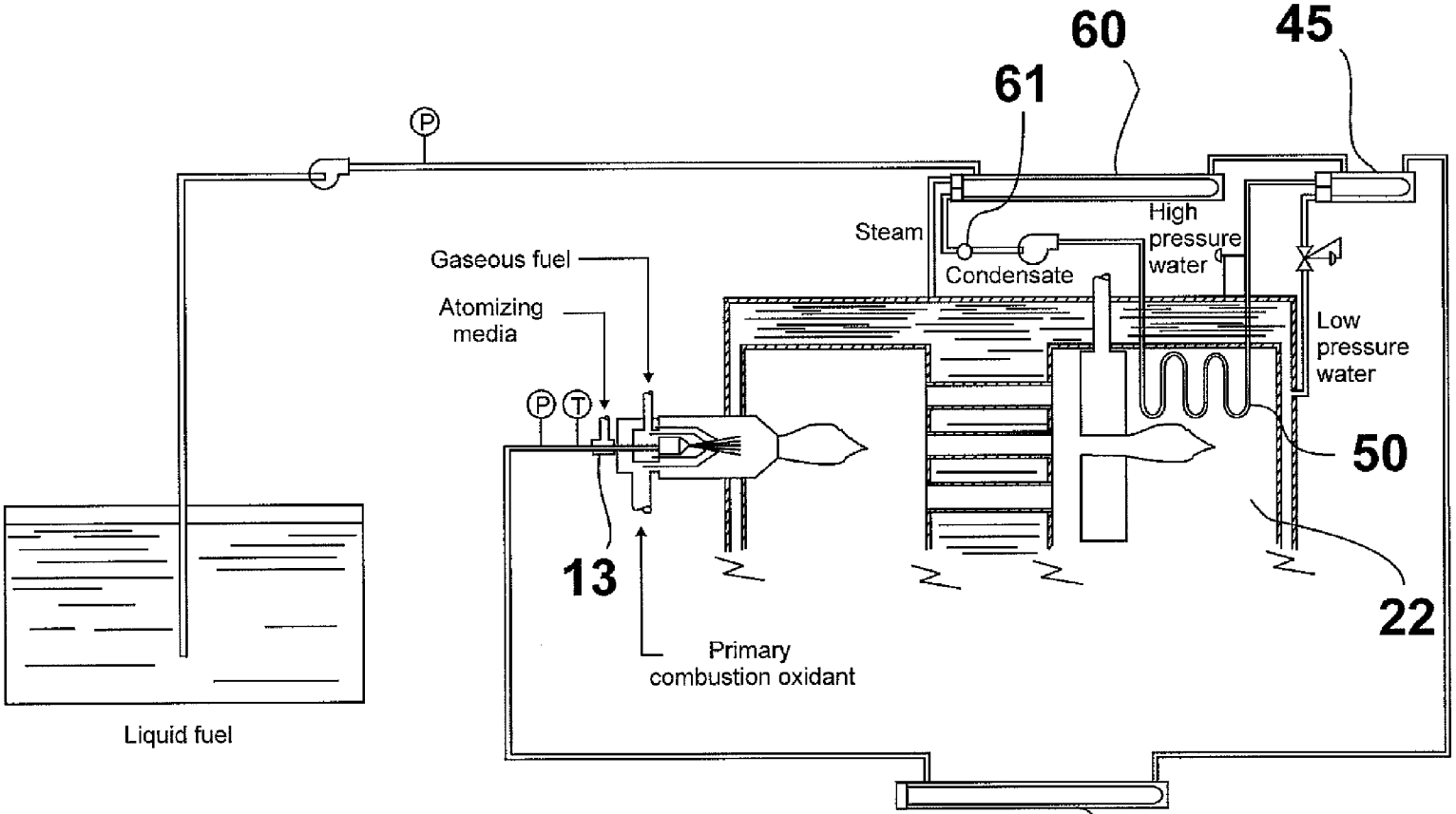
FIG. 8 is a schematic diagram of a lateral view of a portion of a fluid heating apparatus employing dual-fuel combustion and using an electric liquid fuel heater in accordance with one embodiment of this invention.

In accordance with one embodiment of this invention, steam produced by the fluid heating apparatus is used as an atomizing medium. FIG. 8 shows one embodiment of the dual-fuel fluid heating apparatus of this invention comprising a steam-liquid fuel heater 60. As shown therein, steam which condenses during the heat exchange with the liquid fuel is captured and provided by way of check valve 61 to heat exchanger 50 disposed within the second combustion chamber 22.

Figure 9:
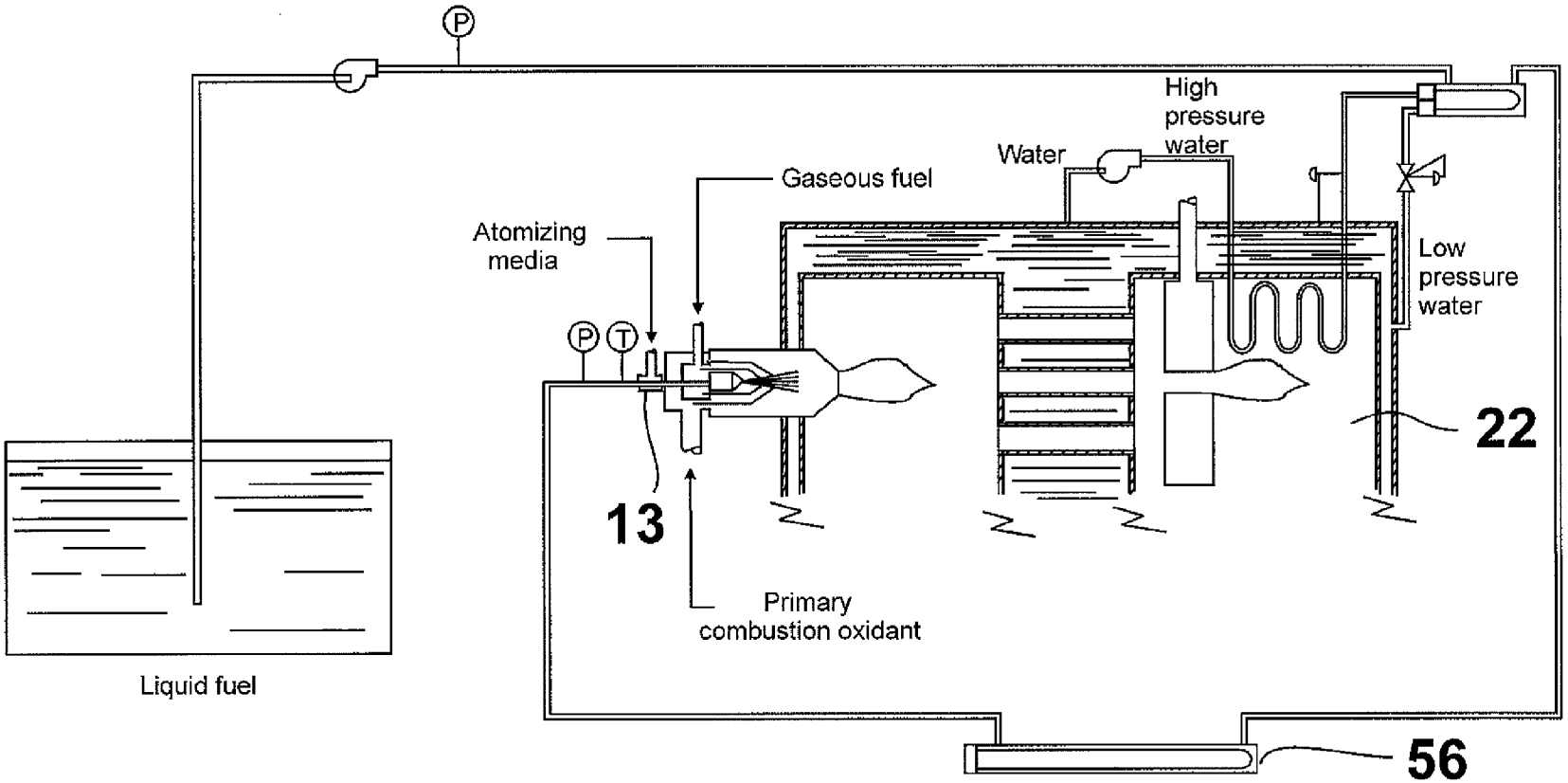
FIG. 9 is a schematic diagram of a lateral view of a portion of a fluid heating apparatus employing dual-fuel combustion and using steam for liquid fuel heating in accordance with one embodiment of this invention.

FIG. 9 shows one embodiment of the apparatus of this invention comprising an electric fuel heater 56 disposed downstream of the water-fuel heater 45 and adapted to receive partially preheated liquid fuel therefrom.

Figure 4:
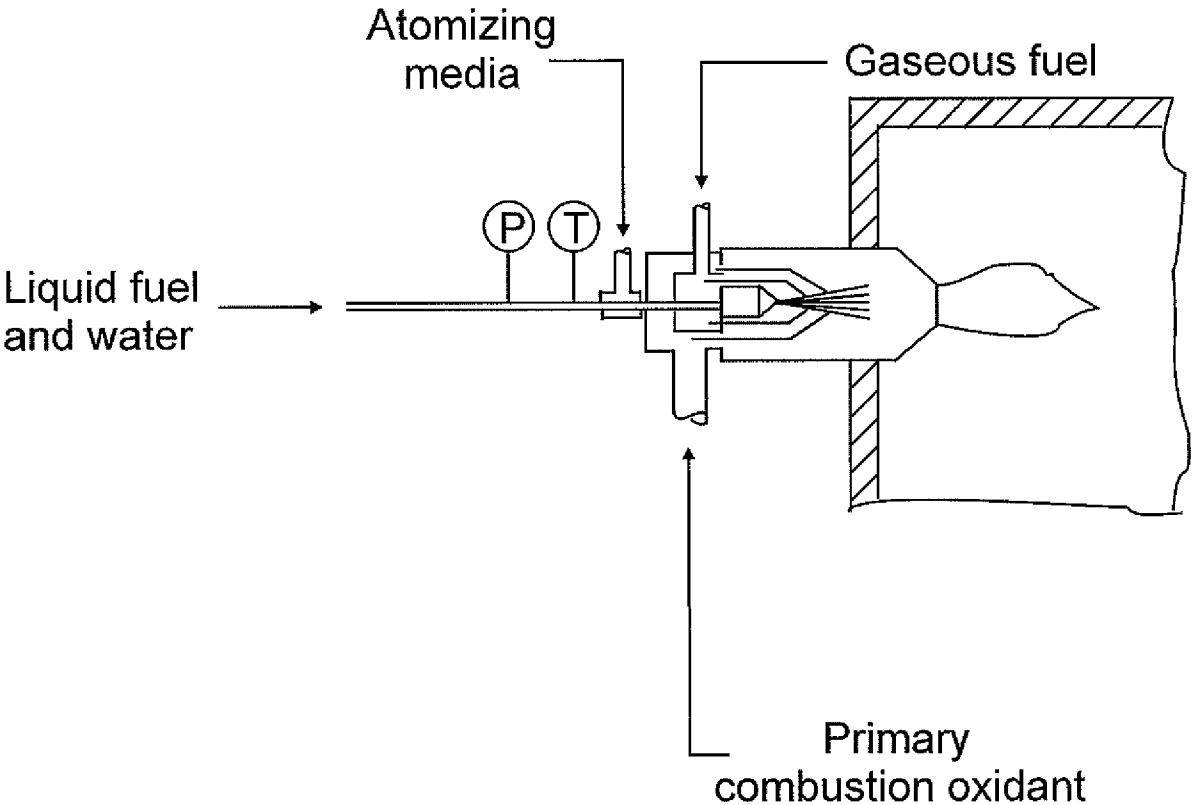
FIG. 4 is a schematic diagram of a dual-fuel burner for combustion of a mixture of liquid fuel and water, referred to herein as a liquid fuel/water mixture, together with a gaseous fuel in accordance with one embodiment of this invention.

In accordance with one embodiment of this invention, the liquid fuel is mixed with water as shown in FIG. 4, producing a water/liquid fuel mixture which is subsequently atomized in atomizer 13 and flash vaporized. Because water evaporation temperature is lower compared with the evaporation temperature of liquid fuels, the water evaporation starts earlier, producing steam which suppresses the formation of soot.

Figure 3:
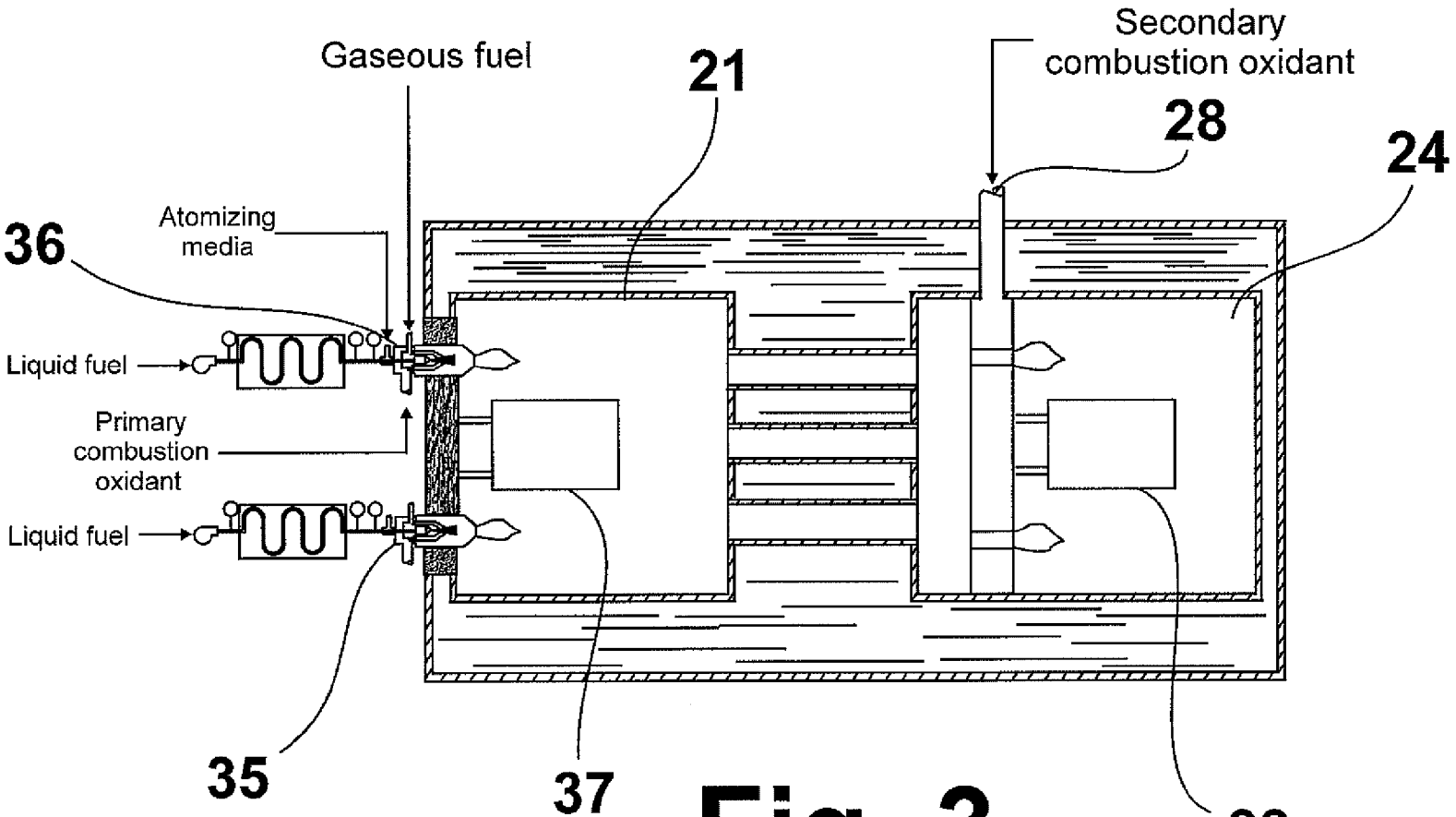
FIG. 3 is a schematic diagram of a lateral view of a fluid heating apparatus employing a plurality of dual-fuel burners for combustion of a liquid and gaseous fuel mixture in accordance with one embodiment of this invention.

In accordance with one embodiment of this invention, the fluid heating apparatus, as shown in FIG. 3, comprises a plurality of dual-fuel combustion devices 35, 36. In accordance with one embodiment of this invention, the apparatus comprises flue gas recirculation means 37, 38 by which flue gas generated in each combustion chamber is recirculated to a base of a flame produced by the corresponding combustion devices. Forced internal recirculation of flue gas in a combustion chamber is discussed in U.S. Pat. No. 6,663,380 and U.S. Pat. No. 6,672,859, both of which are incorporated herein by reference in their entirety.

Figure 10:
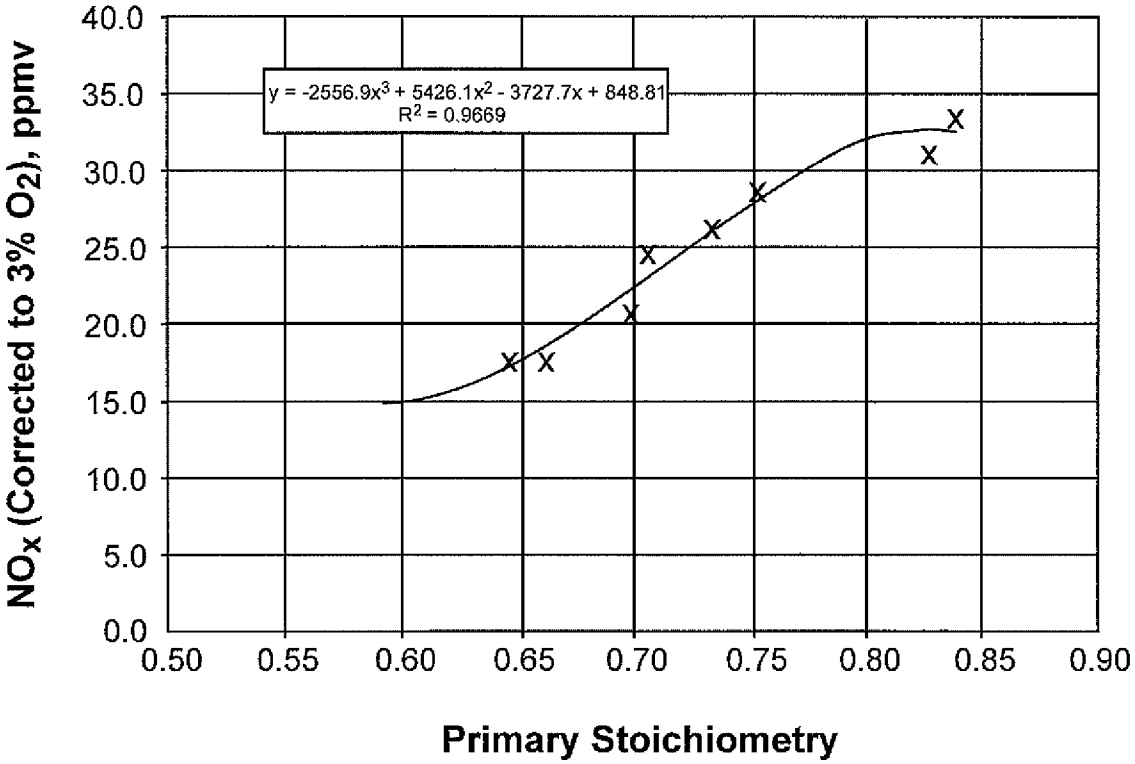
FIG. 10 is a diagram showing an experimentally derived relationship between primary stoichiometry and $NO_x$ formation.

FIG. 10 shows $NO_x$ emissions in a stack as a function of primary stoichiometric ratio resulting from experiments conducted with a dual-fuel combustion apparatus in a two-stage combustion apparatus in accordance with one embodiment of this invention. As shown therein, the amount of $NO_x$ produced is less than about 20 ppmv when the primary stoichiometric ratio is in the range of about 0.64-0.68 when firing No. 2 fuel oil.

Figure 11:
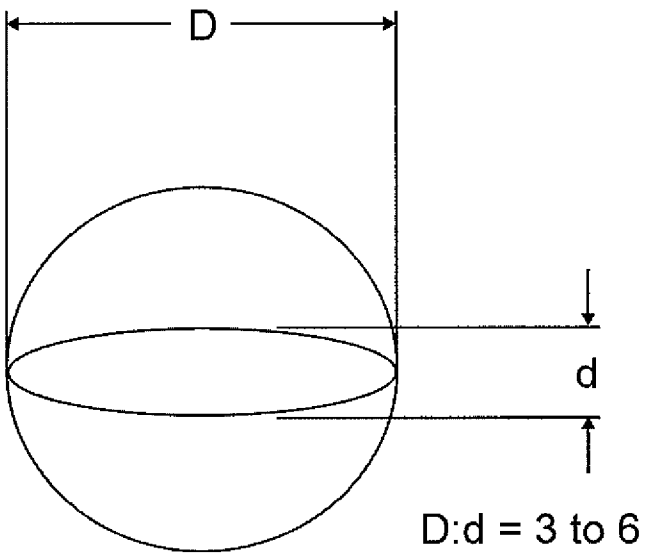
FIG. 11 is a diagram showing preferred shapes of a fuel nozzle in accordance with one embodiment of this invention.
Figure 11:
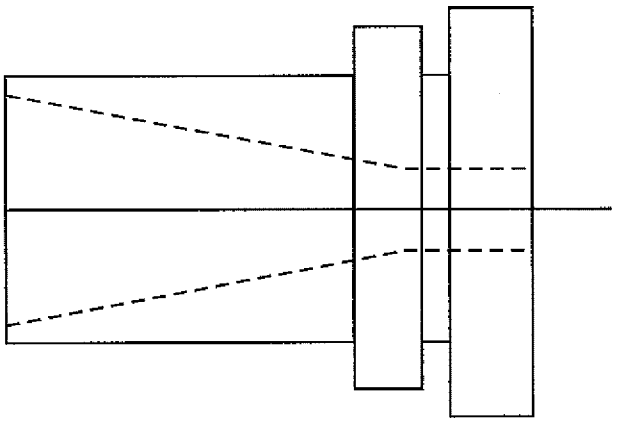

Depending on the desired flame characteristics, the shape of the burner nozzle outlet opening may be modified to achieve the desired flame characteristics. Suitable burner nozzle outlet opening shapes include round, oval, elliptical, rectangular, and combinations thereof. In accordance with one preferred embodiment of this invention, the burner nozzle has an oval shape as shown in FIG. 11 with a ratio of the longest diameter, D, to the shortest diameter, d, in the range of about 3:1 to about 6:1.

Figure 12:
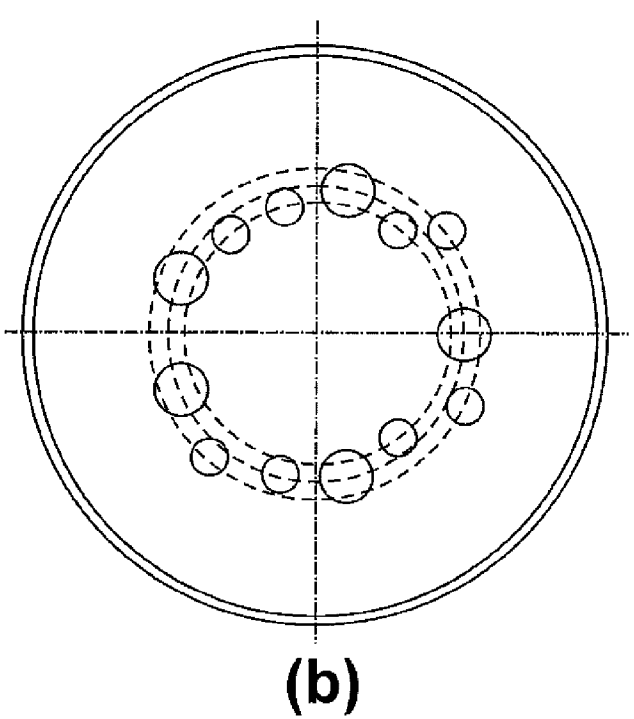
FIG. 12 is a diagram showing fuel nozzle distributions for a fluid heating apparatus in accordance with one embodiment of this invention.
Figure 12:
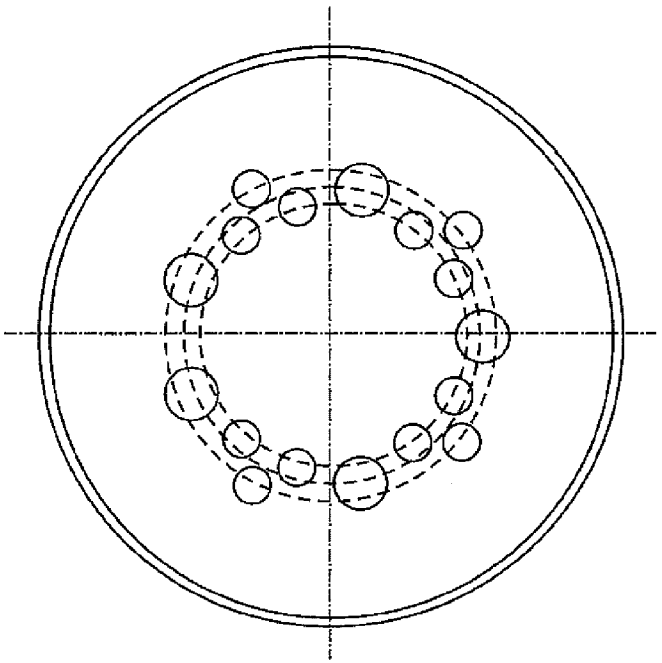

As previously indicated, preferred embodiments of the fluid heating apparatus of this invention comprise a plurality of dual-fuel combustion devices. As shown in FIGS. 12(*a*) and 12(*b*), the burner nozzles may be uniformly distributed around a longitudinal axis of the burner (FIG. 12(*a*)) or non-uniformly distributed around the longitudinal axis of the burner (FIG. 12(*b*)). Also as shown, the burner nozzle outlet openings may vary in diameter. Preferably, the ratio of the diameter of the largest burner nozzle outlet opening to the smallest burner nozzle outlet opening is in the range of about 1:1 to about 2:1.

In the method for dual-fuel combustion in accordance with one embodiment of this invention, the liquid fuel is pressurized to a pressure with a boiling temperature at least higher than about 500° F. followed by preheating the pressurized liquid fuel to a temperature of at least 150° F. above the boiling points of the light fractions of the liquid fuel at atmospheric pressure. The pressurized and preheated liquid fuel is then atomized and in a range of about 15% to about 50%, preferably about 30%, of the atomized liquid fuel is flash evaporated, creating a mixture of fuel vapor and liquid droplets. This mixture is then mixed in a mixing chamber with primary combustion oxidant (and optionally a gaseous fuel) tangentially introduced into the mixing chamber, producing a fuel/primary oxidant mixture which is then injected into a primary combustion chamber in which the fuel/primary oxidant mixture is partially combusted, producing a secondary gaseous fuel containing hydrogen and carbon oxides. The secondary gaseous fuel is then mixed with a secondary combustion oxidant and injected into the second combustion chamber wherein complete combustion of the secondary gaseous fuel is carried out. The resulting second stage flue gas containing very low amounts of $NO_x$ is then vented from the second combustion chamber.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. A method for dual-fuel combustion comprising the steps of:

pressurizing a liquid fuel, wherein a means of pressurizing the liquid fuel comprises a low pressure liquid fuel inlet and a high pressure liquid fuel outlet;

preheating the pressurized liquid fuel, wherein a means of preheating the pressurized liquid fuel comprises at least one of an electric liquid fuel preheater, a water-liquid fuel preheater, and a steam-liquid fuel preheater; wherein said pressurized liquid fuel preheating means further comprises a water-fuel heater having a pressurized preheated liquid fuel inlet in fluid communication with said means of preheating the pressurized liquid fuel and having a pressurized preheated water inlet in fluid communication with a pressurized water preheater;

atomizing the preheated liquid fuel, producing an atomized liquid fuel;

flash vaporing up to about 50% of said atomized liquid fuel, producing a liquid fuel mixture comprising said atomized liquid fuel and a vaporized fuel;

mixing said liquid fuel mixture with a primary combustion oxidant in a mixing chamber, producing a fuel/oxidant mixture having a primary stoichiometry less than about 1.0;

introducing said fuel/oxidant mixture into a first combustion chamber in which partial combustion of said fuel/oxidant mixture occurs, producing a secondary fuel gas;

cooling said secondary fuel gas, producing a cooler secondary fuel gas;

mixing said cooler secondary fuel gas with a secondary combustion oxidant, producing a secondary fuel gas/oxidant mixture;

introducing said secondary fuel gas/oxidant mixture into a second combustion chamber in which substantially complete combustion of said secondary fuel gas/oxidant mixture occurs, producing flue gases; and venting said flue gases from said second combustion chamber.

2. The method of claim 1, wherein in a range of about 15% to about 50% of said atomized liquid fuel is vaporized by said flash vaporizing.

3. The method of claim 1, wherein an amount of said primary combustion oxidant is selected to maintain said primary stoichiometry in a range of about 0.50 to about 0.75.

4. The method of claim 1, wherein a portion of said secondary fuel gas is internally recirculated within said first combustion chamber.

5. The method of claim 1, wherein a portion of said flue gas is internally recirculated within said second combustion chamber.

6. The method of claim 1, wherein said atomized liquid fuel comprises liquid fuel droplets, substantially all of which have a droplet size of less than or equal to about 20 μm.

7. The method of claim 1, wherein said pressurized preheated liquid fuel is mixed with pressurized preheated water, producing a liquid fuel/water mixture.

8. The method of claim 7, wherein said liquid fuel/water mixture is atomized, producing an atomized liquid fuel/water mixture and up to about 50% of said atomized liquid fuel/water mixture is flash vaporized.

9. The method of claim 7, wherein said pressurized water is preheated in a water heater disposed in at east one of said first combustion chamber and said second combustion chamber.

10. The method of claim 1, wherein said secondary fuel gas is cooled to a temperature in a range of about 1100° F. to about 1300° F.

11. The method of claim 1, wherein said pressurized preheated liquid fuel is at a temperature in a range of about 250° F. to about 550° F.

12. The method of claim 11, wherein said pressurized preheated liquid fuel is atomized using an atomizing medium selected from the group consisting of compressed air, steam, vented flue gases, and mixtures thereof.

13. The method of claim 1, wherein a gaseous fuel is mixed with said liquid fuel mixture and said primary combustion oxidant in said mixing chamber.

14. An apparatus for dual-fuel combustion comprising:

a pressurized liquid fuel preheating means for preheating a pressurized liquid fuel, said pressurized liquid fuel preheating means having a pressurized liquid fuel inlet, and a pressurized preheated liquid fuel outlet, said pressurized preheated liquid fuel outlet in fluid communication with a liquid fuel atomizer, wherein said pressurized liquid fuel preheating means comprises an electric liquid fuel preheater, wherein said pressurized liquid fuel preheating means further comprises a water-fuel heater having a pressurized preheated liquid fuel inlet in fluid communication with said electric liquid fuel preheater and having a pressurized preheated water inlet in fluid communication with a pressurized water preheater:

said liquid fuel atomizer having a liquid fuel inlet and an atomized liquid fuel outlet;

flash vaporization means for flash vaporizing a portion of an atomized liquid fuel;

a mixing chamber having an atomized liquid fuel inlet in fluid communication with said atomized liquid fuel outlet, a primary combustion oxidant inlet, and a combustible mixture outlet;

a first combustion chamber having at least one combustible mixture inlet in fluid communication with said combustible mixture outlet and having a first stage combustion products outlet; and a second combustion chamber having at least one first stage combustion products inlet in fluid communication with said first stage combustion products outlet, a secondary combustion oxidant inlet, and a second stage combustion products outlet.

15. The apparatus of claim 14 further comprising a cooling chamber having a heated first stage combustion products inlet in fluid communication with said first stage combustion products outlet and having a cooler first stage combustion products outlet in fluid communication with said first stage combustion products inlet.

16. The apparatus of claim 14, wherein said apparatus is a fuel-fired boiler.

17. The apparatus of claim 16, wherein the pressurized water preheater disposed within one of said first combustion chamber and said second combustion chamber.

18. The apparatus in accordance with claim 14, wherein said mixing chamber has a gaseous fuel inlet.

19. The apparatus of claim 14 further comprising combustion products recirculation means for internally recirculating combustion products disposed in at least one of said first combustion chamber and said second combustion chamber.

20. An apparatus for dual-fuel combustion comprising:

a liquid fuel pressurizing means having low pressure liquid fuel inlet and high pressure liquid fuel outlet;

a pressurized liquid fuel preheating means for preheating the pressurized liquid fuel, said pressurized liquid fuel preheating means having a pressurized liquid fuel inlet, and a pressurized preheated liquid fuel outlet, said pressurized preheated liquid fuel outlet in fluid communication with a liquid fuel atomizer, wherein said pressurized liquid fuel preheating means comprises a steam-fuel preheater having a pressurized liquid fuel inlet, a steam inlet in fluid communication with a steam source, heat exchange means for transferring heat from steam to said pressurized liquid fuel, a steam preheated liquid fuel outlet, and a condensate outlet;

said liquid fuel atomizer having a liquid fuel inlet and an atomized liquid fuel outlet;

flash vaporization means for flash vaporizing a portion of an atomized liquid fuel;

a mixing chamber having an atomized liquid fuel inlet in fluid communication with said atomized liquid fuel outlet, a primary combustion oxidant inlet, and a combustible mixture outlet;

a first combustion chamber having at least one combustible mixture inlet in fluid communication with said combustible mixture outlet and having a first stage combustion products outlet; and a second combustion chamber having at least one first stage combustion products inlet in fluid communication with said first stage combustion products outlet, a secondary combustion oxidant inlet, and a second stage combustion products outlet.

21. The apparatus of claim 20, wherein said pressurized liquid fuel preheating means further comprises a pressurized water preheater disposed within one of said first combustion chamber and said second combustion chamber having a condensate inlet in fluid communication with said condensate outlet and having a pressurized preheated water outlet, a water-liquid fuel preheater having a steam preheated liquid fuel inlet in fluid communication with said steam preheated liquid fuel outlet, a pressurized preheated water inlet in fluid communication with said pressurized preheated water outlet, and a pressurized water-preheated liquid fuel outlet, and an electric fuel heater having a water-preheated liquid fuel inlet in fluid communication with said pressurized water-preheated liquid fuel outlet and having an electric preheated liquid fuel outlet in fluid communication with said liquid fuel atomizer.

* * * * *